US006050102A

United States Patent [19]

Jin

[11] Patent Number: 6,050,102

[45] Date of Patent: Apr. 18, 2000

[54] HEAT PUMP TYPE AIR CONDITIONING APPARATUS

[76] Inventor: Keum Su Jin, Room 401 Jupung Village, 316-8, Kil-Dong, Kangdong-Ku, Seoul, Rep. of Korea

[21] Appl. No.: 09/274,196

[22] Filed: Mar. 22, 1999

[30] Foreign Application Priority Data

Apr. 15, 1998 [KR] Rep. of Korea ..... 98-13445

[51] Int. Cl.[7] ..... F25B 13/00

[52] U.S. Cl. ..... 62/324.6; 62/324.1

[58] Field of Search ..... 62/324.6, 324.1

[56] References Cited

U.S. PATENT DOCUMENTS

| | | | |
|---|---|---|---|
| 3,362,184 | 1/1968 | Jensen . | |
| 4,869,074 | 9/1989 | Hoshi et al. | 62/324.1 X |
| 5,088,296 | 2/1992 | Hamaoka | 62/324.1 X |
| 5,491,981 | 2/1996 | Kim | 62/324.6 |

FOREIGN PATENT DOCUMENTS

| | | |
|---|---|---|
| 49-18927 | 5/1974 | Japan . |
| 54-45949 | 4/1979 | Japan . |

*Primary Examiner*—Henry Bennett
*Attorney, Agent, or Firm*—Hedman, Gibson & Costigan, P.C.

[57] ABSTRACT

A heat pump type air conditioning apparatus is disclosed. In the apparatus, a first heat exchanger is mounted to a refrigerant conduit at a position between an indoor heat exchanger and a heater-mode capillary tube. A second heat exchanger is mounted to the conduit at a position between an outdoor heat exchanger and a four way valve while being positioned higher than the first heat exchanger. The first and second heat exchangers are filled with actuation fluid and vaporize both remaining liquid refrigerant and incompletely vaporized gaseous refrigerant from the outdoor heat exchanger using the actuation fluid vaporized by liquid refrigerant from the indoor heat exchanger. In another embodiment, an auxiliary heating unit is connected to the first heat exchanger and is operated when the temperature of atmospheric air is exceedingly low in days of cold weather. In the auxiliary heating unit, a third heat exchanger is mounted to the first heat exchanger. A heating tank, having an actuation fluid chamber and a heating chamber, is connected to the third heat exchanger. A plurality of heat pipes are vertically set in the actuation fluid chamber and are individually vacuum-filled with actuation fluid.

3 Claims, 4 Drawing Sheets

HEAT PUMP TYPE AIR CONDITIONING APPARATUS

BACKGROUND OF THE INVENTION

1. Field of the Invention

The present invention relates, in general, to heat pump type air conditioning apparatuses and, more particularly, to an improvement in such apparatuses to accomplish a desired evaporation efficiency of gaseous refrigerant returning to a compressor during a heater-mode operation of such an apparatus.

2. Description of the Prior Art

As well known to those skilled in the art, a heater-mode operation of a known heat pump type air conditioning apparatus is performed with the refrigeration cycle of a cooler-mode operation of the apparatus being reversed. However, the evaporation efficiency of gaseous refrigerant during such a heater-mode operation may be reduced when atmospheric air has a low temperature. Such a low temperature atmospheric air thus results in a lacking of heating calories during a heater-mode operation of such an air conditioning apparatus. This reduces the room heating effect of the apparatus when the temperature of atmospheric air is low in days of cold weather. Heat pump type air conditioning apparatuses capable of overcoming this problem have been actively studied recently.

Known heat pump type air conditioning apparatuses, designed to overcome the above-mentioned problem, are referred to in Japanese Utility Model Publication No. Sho. 49-18927 and Japanese Patent Publication No. Sho. 54-45949. In the air conditioning apparatus of No. 49-18927, main and auxiliary indoor heat exchangers are installed in a refrigeration circuit. In a cooler-mode operation of the apparatus, one of the two indoor heat exchangers is used as an evaporator for vaporizing refrigerant, with the other heat exchanger being stopped. Meanwhile, during a cooler-mode operation, all the two indoor heat exchangers are used as condensers for heating room air. On the other hand, in the air conditioning apparatus of No. 54-45949, a refrigerant heater is mounted on a refrigeration circuit. The above refrigerant heater is used as an evaporator during a heater-mode operation of the apparatus. During such a heater-mode operation of the apparatus, the highly-pressurized, hot gaseous refrigerant from a compressor is condensed and liquidized at an indoor heat exchanger while heating room air. Thereafter, the refrigerant is reduced in pressure at a heater-mode capillary tube, thus becoming a low pressure refrigerant. The low pressure refrigerant from the heater-mode capillary tube is, thereafter, vaporized at the refrigerant heater, thereby accomplishing a desired room heating effect even when the atmospheric air has a low temperature.

However, the apparatus of No. 49-18927 is problematic in that the two indoor heat exchangers, selectively used as a condenser during a heater-mode operation, are designed to use the compressor as a heat source when the two indoor heat exchangers heat the room air. This forces the apparatus to use a large capacity compressor and results in an increase in the production and maintenance cost of the apparatus. Another problem of the apparatus resides in that the volume of the indoor heat exchangers is exceedingly enlarged. Therefore, the apparatus needs a large area for installing the indoor heat exchangers and this gives a limitation on where the apparatuses may be installed due to insufficient area.

On the other hand, the apparatus of No. 54-45949 has the following problems. That is, the document discloses that a refrigerant heater is selectively used as an evaporator during a heater-mode operation of the apparatus. However, the document fails to describe the construction of the refrigerant heater in detail. When designing the apparatus while considering the structural limit of a conventional evaporator, it is necessary for those skilled in the art to use a typical electric heater as the refrigerant heater since the electric heater has a small volume and is easily installed. However, such an electric heater regrettably increases the maintenance cost of the air conditioning apparatus.

SUMMARY OF THE INVENTION

Accordingly, the present invention has been made keeping in mind the above problems occurring in the prior art, and an object of the present invention is to provide a heat pump type air conditioning apparatus, which heats and vaporizes both remaining liquid refrigerant and incompletely vaporized gaseous refrigerant from an outdoor heat exchanger using condensed liquid refrigerant from an indoor heat exchanger when such liquid and gaseous refrigerant is introduced from the outdoor heat exchanger into a compressor during a heater-mode operation, and which, thus, effectively generates desired heating calories during a heater-mode operation in the case of low temperature atmospheric air, and which is preferably reduced in the maintenance cost.

In order to accomplish the above object, the present invention provides a heat pump type air conditioning apparatus, comprising a compressor, a four way valve, an indoor heat exchanger, a cooler-mode capillary tube, a heater-mode capillary tube, and an outdoor heat exchanger orderly connected to each other into a refrigeration circuit using both a first conduit and a return conduit, further comprising: a first heat exchanger mounted to the first conduit at a position between the indoor heat exchanger and the heater-mode capillary tube; and a second heat exchanger mounted to the first conduit at a position between the outdoor heat exchanger and the four way valve while being positioned higher than the first heat exchanger, the second heat exchanger being also connected to the first heat exchanger through a first connection pipe having an on-off valve, thus forming a closed circuit, with the first and second heat exchangers being filled with actuation fluid and vaporizing both remaining liquid refrigerant and incompletely vaporized gaseous refrigerant from the outdoor heat exchanger using the actuation fluid heated and vaporized by liquid refrigerant from the indoor heat exchanger.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
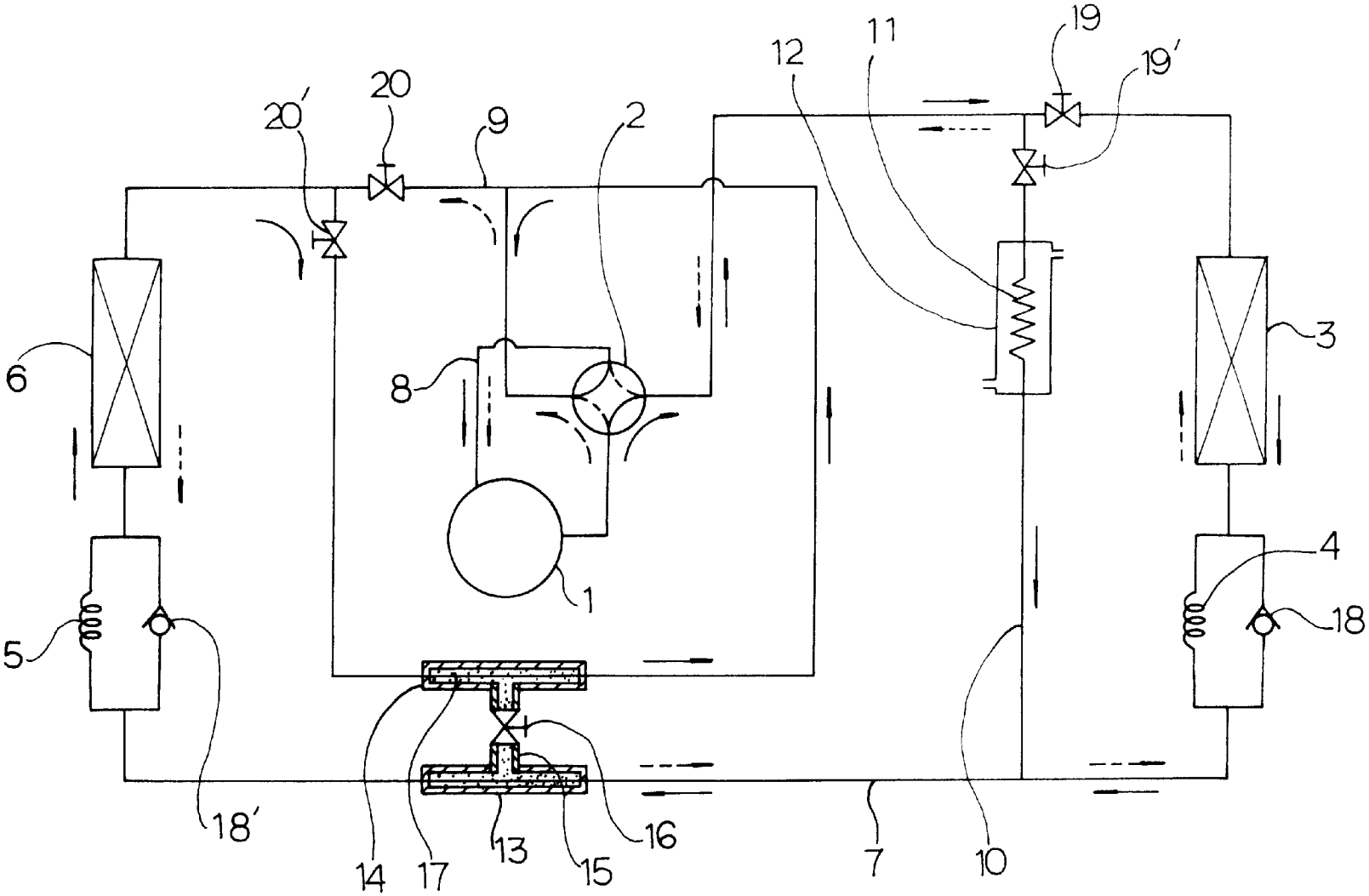
FIG. 1 is a connection diagram showing the refrigeration circuit of a heat pump type air conditioning apparatus in accordance with the primary embodiment of the present invention.

FIG. 1 shows the refrigeration circuit of a heat pump type air conditioning apparatus in accordance with the primary embodiment of this invention. In the refrigeration circuit of the air conditioning apparatus according to the primary embodiment, a compressor 1, a four way valve 2, an indoor heat exchanger 3, a cooler-mode capillary tube 4, a heater-mode capillary tube 5, and an outdoor heat exchanger 6 are orderly connected to each other through a first conduit 7 in series with the outdoor heat exchanger 6 being finally connected to the four way valve 2. A return conduit 8 extends from the four way valve 2 to an inlet of the compressor 1. During a heater-mode operation of the apparatus, refrigerant flows in a direction as shown by the solid arrows of the drawing. On the other hand, the refrigerant flows in another direction as shown by the dotted arrows during a cooler-mode operation. A second conduit 9 extends from a heater-mode inlet of the four way valve 2 to a cooler-mode inlet of the outdoor heat exchanger 6. A bypass conduit or a third conduit 10 extends from the first conduit 7 and is used for bypassing refrigerant from the indoor heat exchanger 3. A condenser 11 is mounted to the third conduit 10. The above condenser 11 is received in a water tank 12.

The reference numeral 13 denotes a first heat exchanger which is mounted to the first conduit 7 at a position between the indoor heat exchanger 3 and the heater-mode capillary tube 5.

The refrigeration circuit also has a second heat exchanger 14. The second heat exchanger 14 is mounted to the first conduit 7 at a position between the outdoor heat exchanger 6 and the four way valve 2 while being positioned higher than the first heat exchanger 13. The second heat exchanger 14 is connected to the first heat exchanger 13 through a first connection pipe 15 provided with an on-off valve 16, thus forming a closed circuit. Both the first and second heat exchangers 13 and 14 are vacuum-filled with actuation fluid 17, such as distilled water or alcohol. During a heater-mode operation and/or a water heating operation of the apparatus, the two heat exchangers 13 and 14 vaporize the actuation fluid 17 using hot liquid refrigerant from the indoor heat exchanger 3 prior to circulating the actuation fluid 17 in a direction toward the second heat exchanger 14. Therefore, the apparatus of this invention almost completely vaporizes both the remaining liquid refrigerant and the incompletely vaporized gaseous refrigerant flowing from the outdoor heat exchanger 6 in the case of low temperature atmospheric air.

In FIG. 1, the reference numerals 18 and 18' individually denote a check valve, 19 and 19' denote first and second control valves used for switching the operational mode of the apparatus between the heater-mode operation and the water heating operation, 20 and 20' denote third and fourth control valves used for switching the operational mode of the apparatus between the heater-mode operation and the cooler-mode operation.

In a heater-mode operation of the apparatus, the first and fourth valves 19 and 20' are opened, while the other control valves 19' and 20 are closed. On the other hand, during a water heating operation, the second valve 19' is opened, while the first valve 19 is closed with the other valves 20 and 20' being controlled in the same manner as that described for the heater-mode operation. When the apparatus performs both a heater-mode operation and a water heating operation at the same time, the first and second valves 19 and 19' are opened. During a cooler-mode operation, the first and third valves 19 and 20 are opened, while the second and fourth valves 19' and 20' are closed.

During a heater-mode operation and/or a water heating operation, the four way valve 2 is switched to allow the refrigerant to flow in a direction as shown by the solid arrows of FIG. 1. In such a case, the refrigerant of the circuit circulates as follows. That is, the highly-pressurized, hot gaseous refrigerant from the compressor 1 primarily passes through the four way valve 2 prior to flowing into the indoor heat exchanger 3 used as a condenser. The gaseous refrigerant is thus condensed and liquidized at the indoor heat exchanger 3 while dissipating heat of condensation into a room, thus heating room air. When the second valve 19' is opened so as to allow the refrigerant to flow into the condenser 11 during the above operation, the condenser 11 dissipates heat of condensation into the water tank 12, thus heating water in the tank 12. The liquid refrigerant, losing the heat of condensation at the condenser 11, flows from the condenser 11 into the heater-mode capillary tube 5, thus being reduced in pressure and becoming low temperature refrigerant at the capillary tube 5. In such a case, the refrigerant from the condenser 11 may pass through the first check valve 18 prior to being introduced into the heater-mode capillary tube 5. The refrigerant also may pass through the first conduit 7 without passing through the check valve 18. The low temperature refrigerant from the heater-mode capillary tube 5 is, thereafter, introduced into the outdoor heat exchanger 6. In the outdoor heat exchanger 6, the refrigerant becomes low pressure, low temperature gaseous refrigerant using atmospheric air as a heat source. Thereafter, the refrigerant passes through the four way valve 2 and the return conduit 8 in order, prior to being recovered by the compressor 1.

When the atmospheric air during such a heater-mode operation and/or a water heating operation has a low temperature, the evaporation efficiency of the refrigerant from the outdoor heat exchanger 6 is reduced in proportion to the temperature of the atmospheric air. This may result in a lacking of heating calories. However, the air conditioning apparatus of this invention solves this problem. That is, the above problem is overcome by the actuation fluid 17 circulating as follows. The valve 16 of the first connection pipe 15 extending between the first and second heat exchangers 13 and 14 is primarily opened. The actuation fluid 17 of the first heat exchanger 13 is thus heated and vaporized by the hot, liquid refrigerant from the indoor heat exchanger 3 prior to flowing into the second heat exchanger 14. In the second heat exchanger 14, the actuation fluid 17 is condensed while almost completely vaporizing both the remaining liquid refrigerant and the incompletely vaporized gaseous refrigerant flowing from the outdoor heat exchanger 6. Thereafter, the actuation fluid 17 flows from the second heat exchanger 14 into the first heat exchanger 13 wherein the actuation fluid 17 is heated by the liquid refrigerant from the indoor heat exchanger 3. The apparatus of this invention thus almost completely vaporizes both the remaining liquid refrigerant and the incompletely vaporized gaseous refrigerant from the outdoor heat exchanger 6. This improves the evaporation efficiency of the gaseous refrigerant returning from the outdoor heat exchanger 6 to the compressor 1, thus increasing the coefficient of performance of the apparatus. The apparatus of this invention is thus free from a lacking of heating calories even thought atmospheric air has a low temperature.

During a cooler-mode operation of the apparatus, the four way valve 2 is controlled to allow the refrigerant to flow in a direction as shown by the dotted arrows of FIG. 1. In such a case, the refrigerant circulates as follows. That is, the highly-pressurized, hot gaseous refrigerant from the compressor 1 primarily passes through the four way valve 2 and the second conduit 9 in order, prior to flowing into the outdoor heat exchanger 6 used as a condenser. The gaseous refrigerant is thus condensed and liquidized at the outdoor heat exchanger 6. The liquid refrigerant from the outdoor heat exchanger 6 passes through the second check valve 18' prior to being introduced into the cooler-mode capillary tube 4, thus being reduced in pressure and becoming low temperature refrigerant at said capillary tube 4. The low temperature refrigerant from the cooler-mode capillary tube 4 flows into the indoor heat exchanger 3 used as an evaporator, thus cooling the room air. The refrigerant from the indoor heat exchanger 3 passes through the four way valve 2 and the return conduit 8 in order, prior to being recovered by the compressor 1. During such a cooler-mode operation, both the valve 16 of the first connection pipe 15 and the fourth valve 20' are closed, thus stopping the second heat exchanger 14.

Figure 2:
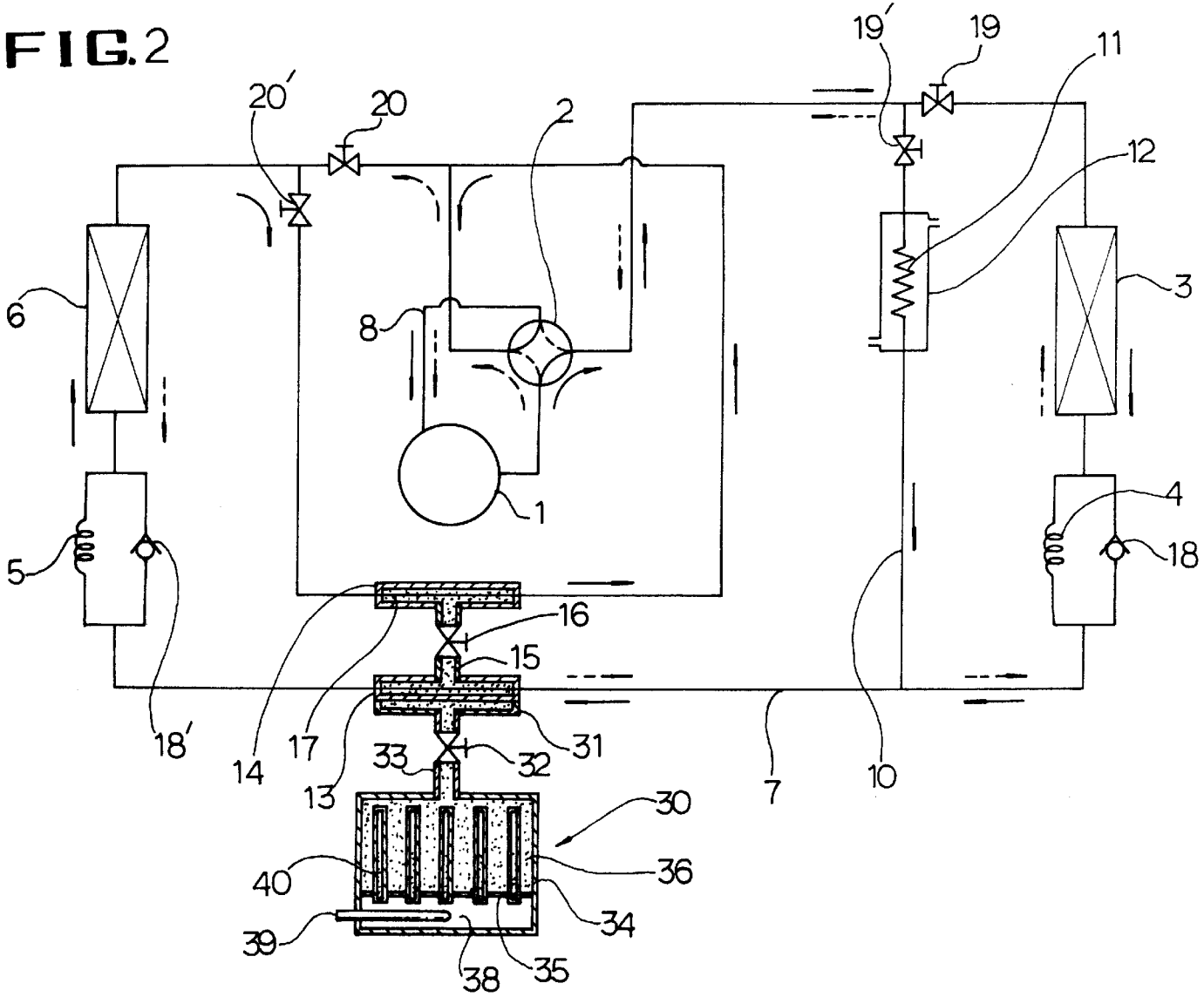
FIG. 2 is a connection diagram showing the refrigeration circuit of a heat pump type air conditioning apparatus in accordance with the second embodiment of the present invention.
Figure 3:
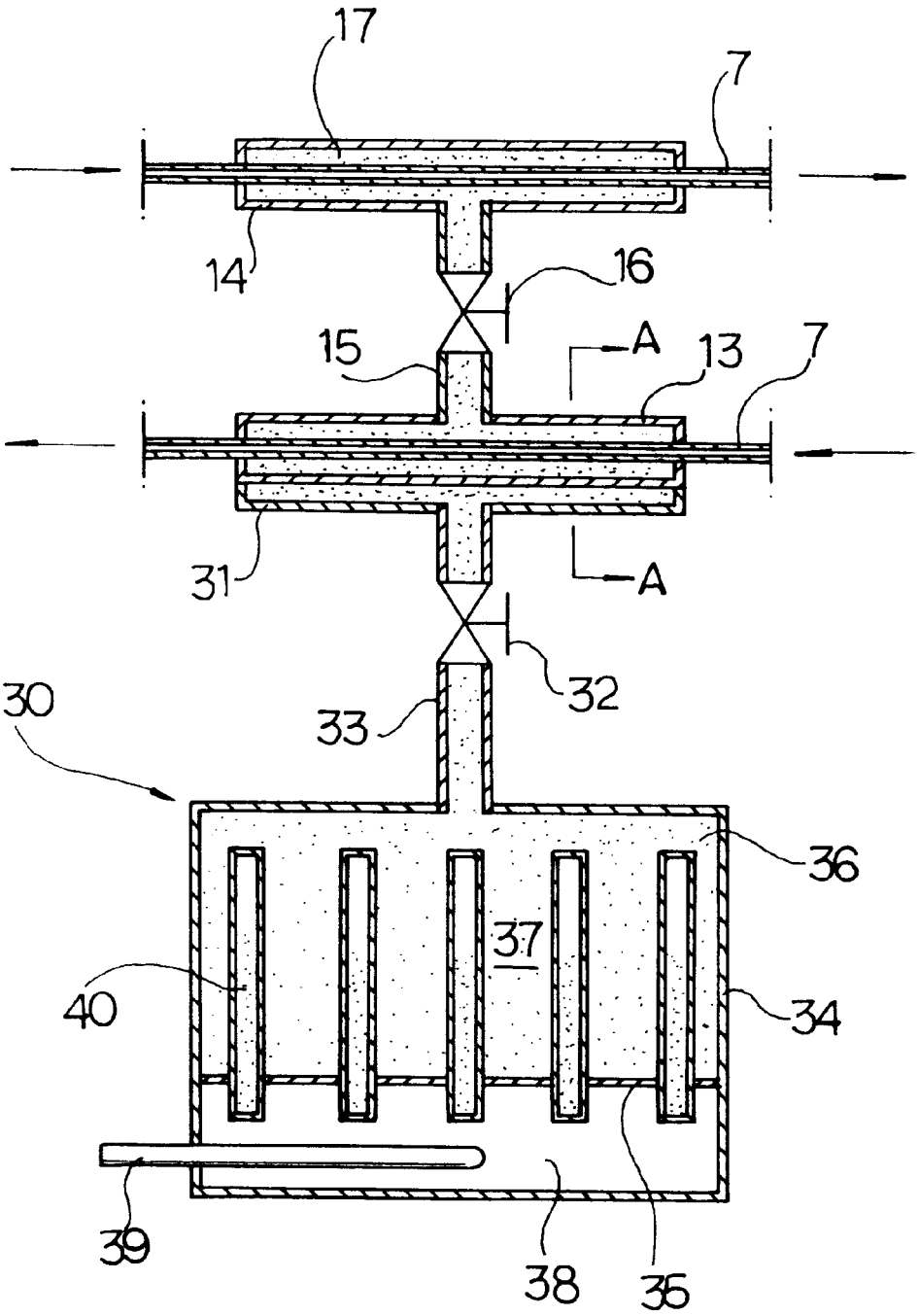
FIG. 3 is a sectional view, showing an auxiliary heating unit connected to a first heat exchanger of the air conditioning apparatus of FIG. 2.
Figure 4:
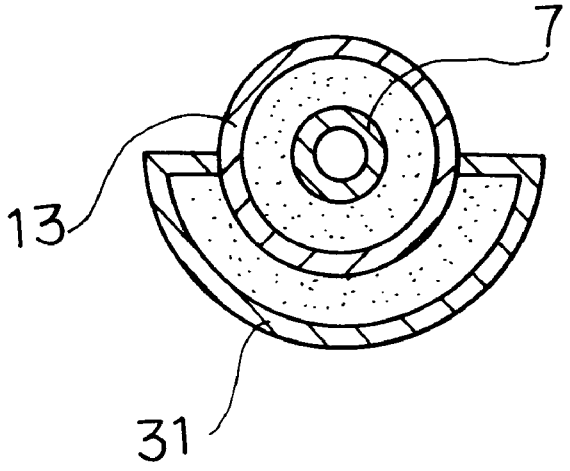
FIG. 4 is a sectional view taken along the line A—A of FIG. 3, showing the first and third heat exchangers integrated with each other into a single body.

FIG. 2 shows the refrigeration circuit of a heat pump type air conditioning apparatus in accordance with the second embodiment of this invention. FIG. 3 is a sectional view, showing an auxiliary heating unit connected to the first heat exchanger of the above apparatus. FIG. 4 is a sectional view taken along the line A—A of FIG. 3, showing first and third heat exchangers integrated with each other into a single body. In the second embodiment, the general shape of the refrigeration circuit, including the first and second heat exchangers 13 and 14, remains the same as that described for the primary embodiment, but an auxiliary heating unit 30 is connected to the first heat exchanger 13 at a position under the heat exchanger 13.

The auxiliary heating unit 30 comprises a third heat exchanger 31 mounted to the bottom of the first heat exchanger 13. A heating tank 34 is connected to the bottom of the third heat exchanger 31 through a second connection pipe 33 provided with an on-off valve 32. The interior of the heating tank 34 is divided into an actuation fluid chamber 36 above and a heating chamber 38 bellow by a horizontal partition wall 35 at a lower portion of the tank 34. In the actuation fluid chamber 36, a plurality of heat pipes 40 are vertically set on the partition wall 35 with the lower ends of the heat pipes 40 being projected into the heating chamber 38. The heat pipes 40 are individually vacuum-filled with actuation fluid 37. In addition, the actuation fluid chamber 36 is also filled with actuation fluid 37. A heating means 39 is installed in the heating chamber 38.

The auxiliary heating unit 30 is not operated with the valve 32 being closed when the temperature of atmospheric air is not exceedingly low. However, when the temperature of atmospheric air is exceedingly low in days of cold weather, the hot liquid refrigerant from the indoor heat exchanger 3 may fail to effectively or completely vaporize both remaining liquid refrigerant and incompletely vaporized gaseous refrigerant from the outdoor heat exchanger 6. This regrettably allows both the remaining liquid refrigerant and the incompletely vaporized gaseous refrigerant to return to the compressor 1 without being completely vaporized. This may result in a lacking of heating calories irrespective of the first and second heat exchangers 13 and 14. In such a case, the auxiliary heating unit 30 is started. In order to start the unit 30, the valve 32 is opened prior to starting the heating means 39. The actuation fluid of the heat pipes 40 is thus vaporized by the heating means 39, while the heat pipes 40 dissipate heat into the fluid chamber 36. The actuation fluid 37 in the fluid chamber 36 is vaporized prior to being introduced into the third heat exchanger 31 through the second connection pipe 33. The actuation fluid 37 in the third heat exchanger 31 auxiliarily heats the actuation fluid 17 of the first heat exchanger 13, thereby improving the evaporation efficiency of the gaseous refrigerant returning from the outdoor heat exchanger 6 to the compressor 1. The apparatus of the second embodiment increases the coefficient of performance and is free from a lacking of heating calories even when the temperature of atmospheric air is exceedingly low in days of cold weather.

In the apparatus of the invention, the two on-off valves 16 and 32 may be manually operated. Alternatively, the two on-off valves 16 and 32 may be automatically operated in response to signals output from a sensor (not shown). In such a case, the sensor may be installed at an outlet of the outdoor heat exchanger 6 or the inlet of the compressor 1 and senses evaporativity of gaseous refrigerant prior to outputting signals to the valves 16 and 32.

As described above, the present invention provides a heat pump type air conditioning apparatus. When there occurs a lacking of heating calories due to low temperature atmospheric air during a heater-mode operation and/or a water heating operation, the apparatus heats and vaporizes both remaining liquid refrigerant and incompletely vaporized gaseous refrigerant from an outdoor heat exchanger using hot liquid refrigerant from an indoor heat exchanger. The apparatus thus improves evaporation efficiency of the gaseous refrigerant returning from the outdoor heat exchanger to the compressor and is free from a lacking of heating calories without having any separate heat source even thought the temperature of atmospheric air is low. The apparatus also has a simple construction, thereby being preferably reduced in maintenance cost.

When the temperature of atmospheric air is exceedingly low in days of cold weather, the hot liquid refrigerant from the indoor heat exchanger may fail to effectively or completely vaporize both remaining liquid refrigerant and incompletely vaporized gaseous refrigerant from the outdoor heat exchanger and results in a lacking of heating calories. In order to solve this problem, the apparatus may have an auxiliary heating unit connected to the first heat exchanger. The auxiliary heating unit auxiliarily heats the actuation fluid of the first heat exchanger, thus improving the evaporation efficiency of the gaseous refrigerant returning from the outdoor heat exchanger to the compressor and allowing the apparatus to be free from any lacking of heating calories. It is necessary for a user to selectively operate the above auxiliary heating unit when the temperature of atmospheric air is exceedingly low in days of cold weather. The apparatus is thus operated at low cost irrespective of the auxiliary heating unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat pump type air conditioning apparatus, comprising a compressor, a four way valve, an indoor heat exchanger, a cooler-mode capillary tube, a heater-mode capillary tube, and an outdoor heat exchanger orderly connected to each other into a closed circuit using both a first conduit and a return conduit, further comprising:

a first heat exchanger mounted to said first conduit at a position between the indoor heat exchanger and the heater-mode capillary tube; and a second heat exchanger mounted to the first conduit at a position between the outdoor heat exchanger and the four way valve while being positioned higher than said first heat exchanger, said second heat exchanger being also connected to the first heat exchanger through a first connection pipe having an on-off valve, thus forming a closed circuit, with the first and second heat exchangers being filled with actuation fluid and vaporizing both remaining liquid refrigerant and incompletely vaporized gaseous refrigerant from the outdoor heat exchanger using the actuation fluid heated and vaporized by liquid refrigerant from the indoor heat exchanger.

2. The heat pump type air conditioning apparatus according to claim 1, wherein an auxiliary heating unit is connected to said first heat exchanger at a position under the first heat exchanger.

3. The heat pump type air conditioning apparatus according to claim 2, wherein said auxiliary heating unit comprises:

a third heat exchanger mounted to a bottom of said first heat exchanger;

a heating tank connected to a bottom of said third heat exchanger through a second connection pipe having an on-off valve, with an interior of the heating tank being divided into an actuation fluid chamber above and a heating chamber bellow by a horizontal partition wall at a lower portion of the tank, said actuation fluid chamber being filled with actuation fluid;

a plurality of heat pipes vertically set on said partition wall within the actuation fluid chamber with lower ends of the heat pipes being projected into the heating chamber, said heat pipes being individually vacuum-filled with actuation fluid; and heating means installed in said heating chamber.

* * * * *